United States Patent [19]

Glushko et al.

[11] Patent Number: 4,641,492

[45] Date of Patent: Feb. 10, 1987

[54] ROPE-TWISTING MACHINE FOR MAKING ROPES

[75] Inventors: Mikhail F. Glushko; Viktor K. Skalatsky; Anatoly D. Zakhryamin, all of Odessa, U.S.S.R.

[73] Assignee: Odessky Nauchno-Issledovatelsky Otdel Stolnykh, Odessa, U.S.S.R.

[21] Appl. No.: 673,612

[22] Filed: Nov. 21, 1984

[51] Int. Cl.[4] ..... D07B 7/00

[52] U.S. Cl. ..... 57/9; 57/138; 57/311

[58] Field of Search ..... 57/215, 6, 9, 138, 311

[56] References Cited

U.S. PATENT DOCUMENTS

| | | | |
|---|---|---|---|
| 400,285 | 3/1889 | Barraclough et al. | 57/138 |
| 1,537,632 | 5/1925 | Turgeon | 57/311 X |
| 2,156,652 | 5/1939 | Harris | 57/9 X |
| 2,476,180 | 7/1949 | Charles | 57/9 |
| 4,471,527 | 9/1984 | Nishijima | 57/138 X |

*Primary Examiner*—Donald Watkins

[57] ABSTRACT

A rope-twisting machine for making ropes includes arranged on a base in succession a rotor carrying rope elements, a mandrel rigidly connected to the rotor and having shaping grooves, pressure rollers mounted in a casing, the axes of the pressure rollers being arranged in planes passing through the axis of rotation of the rotor. The casing is disposed concentrically relative to the mandrel, the casing and the rotor being capable of relative rotation.

8 Claims, 14 Drawing Figures

ROPE-TWISTING MACHINE FOR MAKING ROPES

FIELD OF THE INVENTION

This invention relates to rope making, and more particularly to rope-twisting machines for making ropes.

The present invention can find application in making ropes of various shapes and configurations to be used in fishing, oil prospecting, weight-hoisting and transportation.

BACKGROUND OF THE INVENTION

One problem facing the present-day rope production is associated with reducing the amount of power consumable by rope making processes through reducing rope pulling forces required for rope making, which in turn requires less metal for fabricating rope-twisting machines, results in smaller machine dimensions, makes operation of the machine easier, and causes less frequent breakdowns.

There is known a rope-twisting machine comprising arranged in succession on the base a drive rotor carrying rope elements to be twisted, a means for squeezing the rope elements in the form of a mandrel rigidly secured on the rotor and having shaping grooves, and a drawing die arranged coaxially with the mandrel (cf., U.S. Pat. No. 2,156,652; Cl. 57-145; published 1939).

The means for squeezing the rope elements defines an annular converging neck portion acting to compress or squeeze the rope elements when they are drawn therethrough.

Also, the machine is provided with an additional squeezing means serving for reducing the twisted rope to the final shape and size.

Squeezing of the rope elements in this machine is effected by continuous and simultaneous contact thereof with the squeezing means. Such a squeezing of the rope elements requires increased pulling forces for drawing them away from the squeezing zone and, as a consequence, increased power expenditures.

In addition, the machine must be provided with a powerful mechanism for drawing the rope and a high-power drive. It must further feature increased strength and rigidity of most of its parts and units interacting with the rope drawing mechanism, whereby it becomes bulky, more complicated in operation and less reliable.

There is also known a rope twisting machine comprising arranged on a base in succession a rotor carrying rope elements, a distribution template, and a mechanism for drawing the rope elements being squeezed (cf., British Pat. No. 1,373,814; Cl. D 07 B, published 1974).

The machine is also provided with a mandrel supporting the rope elements and a drawing die coaxially arranged relative to the mandrel, the mandrel and the draw plate being interposed between the rotor and the drawing mechanism.

The rope elements are squeezed in this machine through drawing them from the squeezing zone at a continuous contact of the finished rope with the working surface of the drawing die, which requires a very considerable pulling force to be applied and consequently results in high energy expenditures.

Another disadvantage resides in that the machine is large in size, requires much metal to be consumed for its fabrication, and is difficult to operate and service.

There is further known a rope-twisting machine taken by the inventors as a prototype and comprising arranged in succession on the base a rotor carrying rope elements, a mandrel having shaping grooves and rigidly connected to the rotor, pressure rollers mounted in a casing with axes of the pressure rollers being arranged in planes passing through the axis of rotation of the rotor.

The machine is also provided with a system of deflectable rollers providing for a continuous contact of the rope elements with the mandrel and pressure rollers in the squeezing zone.

It is to be noted that the number of pressure rollers employed in this machine must not be less than the number of rope elements being squeezed, which increases the overall bulk and size of the machine.

For making ropes by this prior art machine the rope elements (round wires or strands) are drawn between the pressure rollers mounted in the casing and the mandrel having the shaping grooves, where the strands are compressed to a required cross-section, the strands thereupon being fed to twisting dies for laying the rope.

However, the rope twisting machine requires much energy to be consumed for rope making again due to the fact that the rope elements are squeezed by pulling them from the squeezing zone.

The rope twisting machine is also bulky and requires much metal for its manufacture. It is consequently complicated in operation and not sufficiently reliable due to excessive number of parts and units directly involved in squeezing the rope elements.

SUMMARY OF THE INVENTION

It is therefore a principle object of the present invention to reduce the amount of power consumable for rope making through reducing the force required for pulling the rope elements from the squeezing zone, and to provide for making ropes from rope elements of various cross-sections.

Another object is to simplify a rope squeezing mechanism of the rope-twisting machine structurally.

One more object is to make the squeezing mechanism of the proposed machine more reliable.

Other objects of the invention are the reduction in the amount of metal to be consumed for manufacture of the machine, the increase in its capacity and provision for easier operation and servicing.

The objects of the invention are attained by that in a rope-twisting machine for making ropes comprising arranged on a base in succession a rotor carrying rope elements, a mandrel rigidly connected to the rotor and having shaping grooves, pressure rollers mounted in a casing with axes of the pressure rollers arranged in planes passing through the axis of rotation of the rotor, according to the invention, the casing is arranged with an eccentricity relative to the mandrel, whereas the casing and the rotor are capable of relative rotation.

Thanks to such a structural arrangement of the rope twisting machine the pressure rollers can, while rotating about the axis of the rotor, intersect the shaping grooves alternately running thereabout and consequently the portions of the rope elements being squeezed which are drawn therethrough, thereby carrying out periodic pulsewise rotational rolling of these portions.

When the rope portions being squeezed are pinched between the working surfaces of the shaping grooves of the mandrel and pressure rollers, the rope elements are stretched due to the pulling force continuously exerted thereon, whereas during the free movement of these elements such a pulling force is released, whereby the rope is twisted at a uniform rate.

This in turn enables to reduce the amount of pulling force required for drawing the rope elements being squeezed from the squeezing zone, reduce the amount of metal consumed for fabricating the machine, simplify the means for squeezing the rope elements, improve the reliability of the machine, and finally obtain ropes of superior quality.

Preferably, the casing is kinematically linked with the rotor to simplify the arrangement of the drive of the means for squeezing the rope elements.

Preferably, the casing is provided with an independent rotating drive to result in an increased operating effieiency of the machine and a substantial reduction in a pulling force required for drawing the rope elements from the rope-squeezing zone.

In order to still more simplify the squeezing means structurally and make it less bulky, the casing is preferably provided with a conterweight secured on its periphery. For complete unloading of the front cantilever end of the rotor carrying the mandrel rigidly connected thereto the casing is preferably rigidly affixed to the base. In such a case the rollers will not only support the mandrel, but also will serve as additional support for the rotor in the portion thereof where loads are the greatest.

To compensate for the wear of the pressure rollers and adjust the degree of squeezing exerted on the rope elements, the axis of each rotor is arranged in the casing with an eccentricity.

For extending the range of the above wear compensation and adjustment of the degree to which the rope elements are squeezed the casing and the pressure rollers are preferably tapered and mounted to be capable of adjustable axial reciprocations.

In order to extend the service life of the mandrel, it is preferable that cavities and passages be provided for feeding a working medium (cooling fluid, compressed air and/or lubricant) to the shaping grooves.

BRIEF DESCRIPTION OF THE DRAWINGS

The invention will now be described in greater detail with reference to various specific embodiments thereof taken in conjunction with the accompanying drawings, in which.

DETAILED DESCRIPTION OF THE INVENTION

Figure 2:
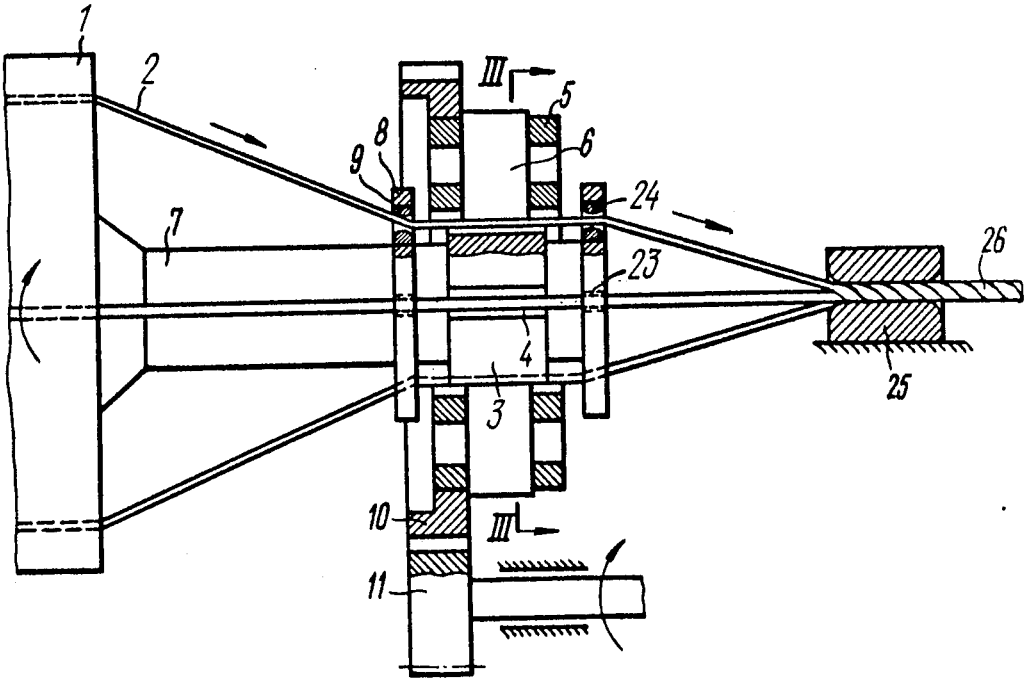
FIG. 2 is a schematic side elevation of a rope-twisting machine according to the invention.

A rope-twisting machine for making ropes comprises arranged on a base in succession a rotor 1 (FIG. 2) carrying rope elements 2, a mandrel 3 (FIG. 2) having shaping grooves 4 and rigidly connected to the rotor 1, and pressure rollers 6 mounted in a casing 5, the axes of the pressure rollers 6 being disposed in planes passing through the axis of rotation of the rotor 1. The casing 5 is arranged concentrically relative to the mandrel 3, while in combination with the rotor 1 they are capable of relative rotation. At a front end 7 of the rotor 1 there is rigidly affixed a distribution template 8 having guide holes 9. The casing 5 may be kinematically linked with the rotor 1, or it may be provided with an individual rotating drive. In such a case the casing 5 is attached to a gear ring 10 engageable with a drive gear 11. Alternatively, other structural arrangements of the drives for rotating the casing 5 are possible, such as by using belt or chain transmissions.

Figure 3:
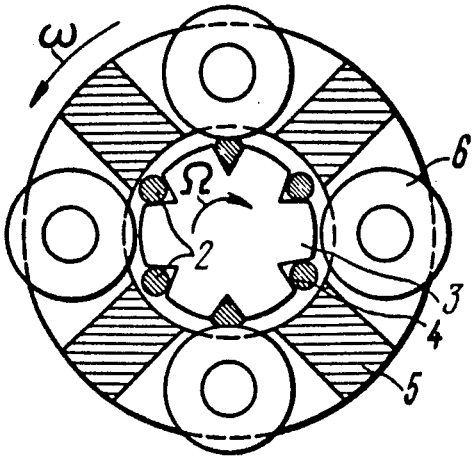
FIG. 3 is a section taken along line III—III in FIG. 2.

The simplest structural arrangement of the proposed machine is one where the pressure rollers 6 (FIG. 3) and the mandrel 3 are cylindrical in shape to define a sort of a rolling-contact bearing.

However, it has to be considered that the mandrel 3 is subjected to bending loads exerted from the side of the casing 5 with the pressure rollers 6, as well as reactive forces exerted from the side of the drive gear 11.

Figure 4:
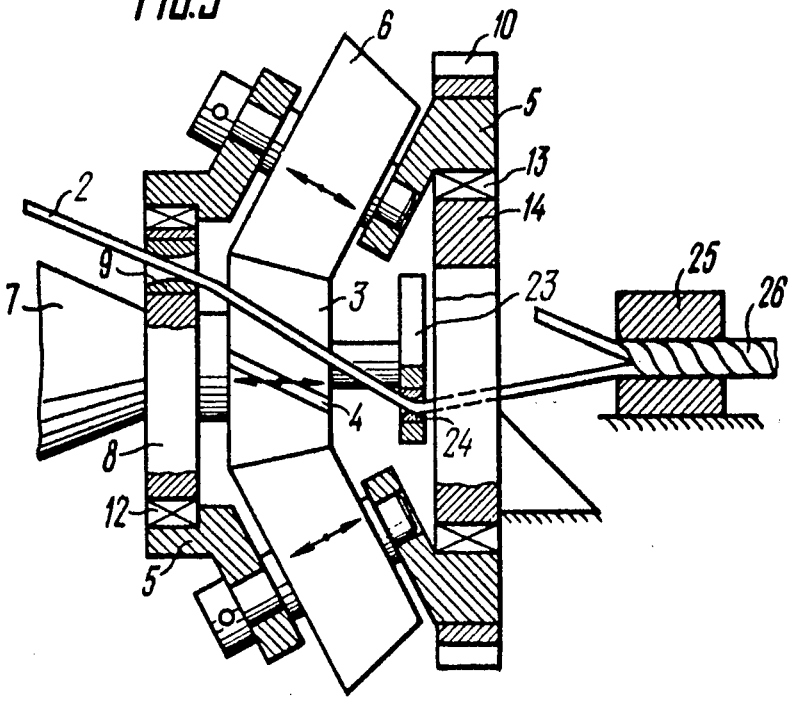
FIG. 4 is substantially the same as illustrated in FIG. 2 with tapered mandrel and pressure rollers.

An alternative modification of the machine is possible where the mandrel 3 and pressure rollers 6 (FIG. 4) are tapered. In this case the casing 5 bears on one side by a bearing 12 on the distribution template 8, while on the other side it bears by a bearing 13 on a fixed bearing ring 14. Therefore, by virtue of the tapered arrangement of the mandrel 3 threading of the rope elements 2 through the holes 9 of the distribution template 8 and shaping grooves 4 of the mandrel 3 is simplified, whereas because the casing 5 bears on the distribution template 8 and the bearing ring 14 bending loads acting on the mandrel 3 become less pronounced.

With such an arrangement of the proposed rope-twisting machine it is preferable that the mandrel 3 and the pressure rollers 6 (FIG. 4) be arranged for independent adjustable axially reciprocable displacement (as indicated by the arrows) to thereby ease threading of the rope elements 2 and ensure that these elements 2 are squeezed with a predetermined amount of pressure.

Figure 5:
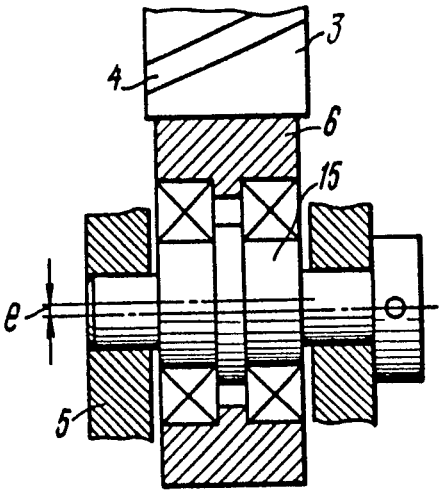
FIG. 5 illustrates a pressure roller on an eccentric shaft.

In other alternative modifications of the proposed rope-twisting machine, particularly one where the pressure rollers 6 and the mandrel 3 (FIG. 2) are cylindrical, it is preferable that the pressure rollers 6 be disposed in the casing 5 on eccentrical shafts 15 (FIG. 5) having an eccentricity "e" to compensate for wear and to adjust the degree to which the rope elements 2 are squeezed.

Figure 6:
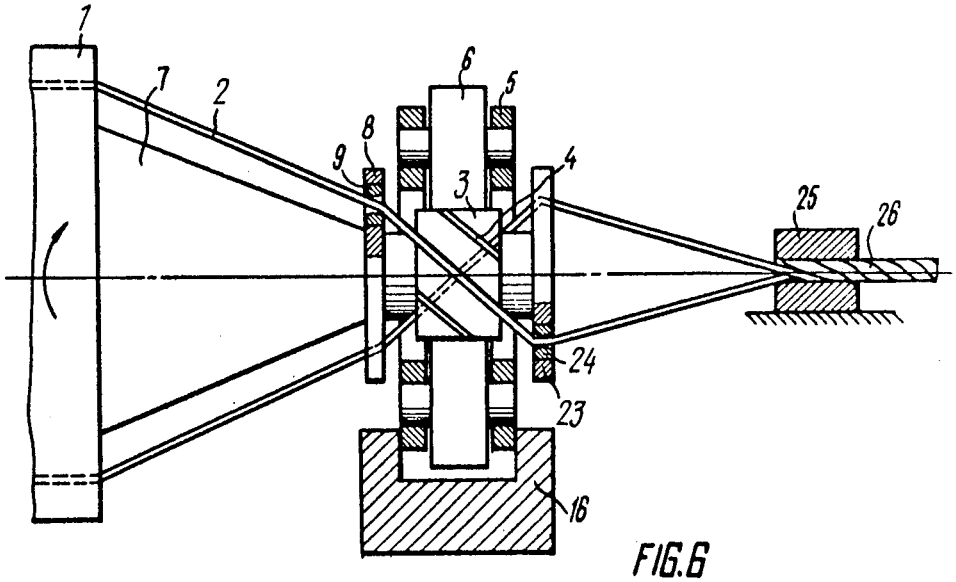
FIG. 6 is substantially the same as shown in FIG. 2 featuring an eccentrically arranged counterweight.

Also possible are modified forms of the proposed rope-twisting machine in which the casing 5 is not driven. In such cases the casing 5 (FIG. 6) is provided with a counterweight 16 secured on its periphery, or it can be rigidly connected to the base (not shown) of the machine.

Figure 7:
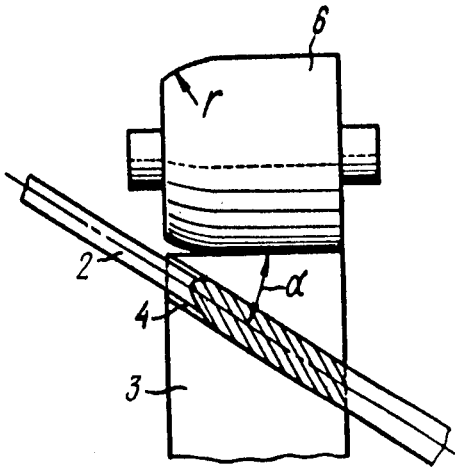
FIG. 7 shows a mandrel with shaping grooves arranged at an angle to its axis and to the axes of the pressure rollers, the rollers having somewhat rounded working surfaces.

In order to avoid local indentations of the surface of the rope elements 2 by the edges of the pressure rollers 6 and to assure smooth engagement of the pressure rollers 6 with the surface of the rope elements 2, the working surface of the pressure rollers 6 (FIG. 7) at least at one edge thereof on the side of the incoming rope elements 2 being squeezed is rounded on a radius "r", or has the form of a truncated cone (not shown).

Figure 8:
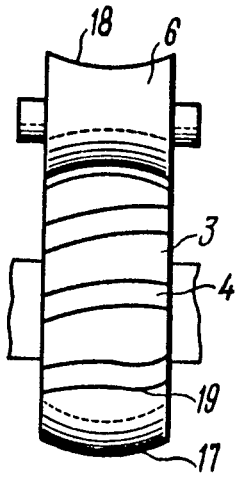
FIG. 8 illustrates a modified form of the mandrel and pressure rollers having curvlinear generatrices.

For forming each of the rope elements 2 being squeezed to a shape close to what it must have in a finished rope (in terms of curvature and twist) it is advisable that the working surfaces of the mandrel 3 and pressure rollers 6 (FIG. 8) be provided with substantially curvilinear generatrices indicated at 17 and 18. Accordingly, for the same purpose the shaping grooves 4 may have curvilinear generatrices 19 (FIG. 8).

Figure 9:
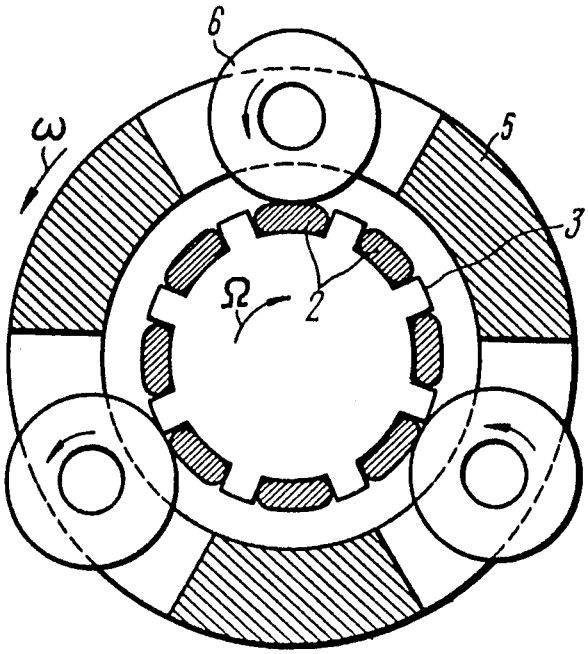
FIG. 9 shows a modification of the mandrel for squeezing the rope elements to a flat or oval configuration.

The proposed rope twisting machine is capable of making all known types of shaped-strand ropes from rope elements or strands 2 such as triangular strands (FIG. 3), oval or flat strands (FIG. 9), as well as spiral ropes comprising layers of the rope elements 2 in the form of wires squeezed into a shaped profile, such as V-shaped, lensshaped, oval, etc.

Figure 10:
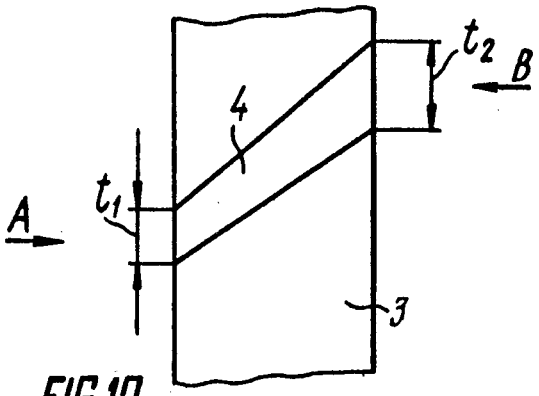
FIG. 10 is a modified form of a shaping groove of the mandrel of variable configuration.
Figure 11:
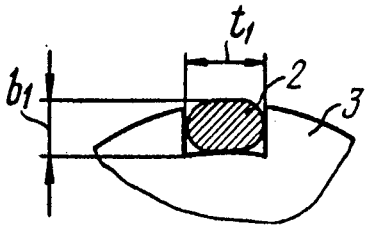
FIG. 11 is a cross-section of the shaping groove shown in FIG. 10.
Figure 12:
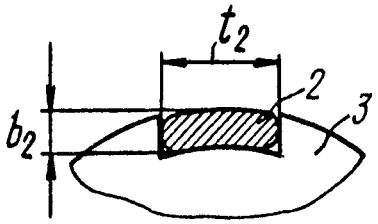
FIG. 12 is substantially the same as shown in FIG. 11 at the groove outlet.

In order to improve conditions for squeezing the rope elements 2 and avoid possible structural damage at high squeezing pressure, which is especially important during squeezing wire strands, it is advisable that the shaping grooves 4 (FIGS. 10 to 12) have variable cross-section, both the width of the groove and the depth thereof varying within a range of from $t_1$ to $t_2$ and from $b_1$ to $b_2$, respectively.

Figure 13:
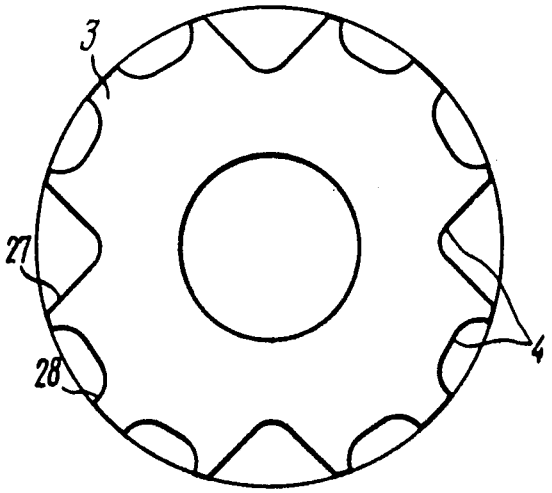
FIG. 13 is a modified form of the mandrel having shaping grooves of various cross-sections.

The proposed rope-twisting machine can be used for producing combined shaped-strand ropes, such as substantially triangular ropes coated with a layer of flat or oval strands. In this case, the mandrel 3 (FIG. 13) has preferably shaping grooves 4 varying in their form and dimensions depending on the predetermined shape, size and number of the rope elements 2 and their predetermined combination in the rope.

Figure 14:
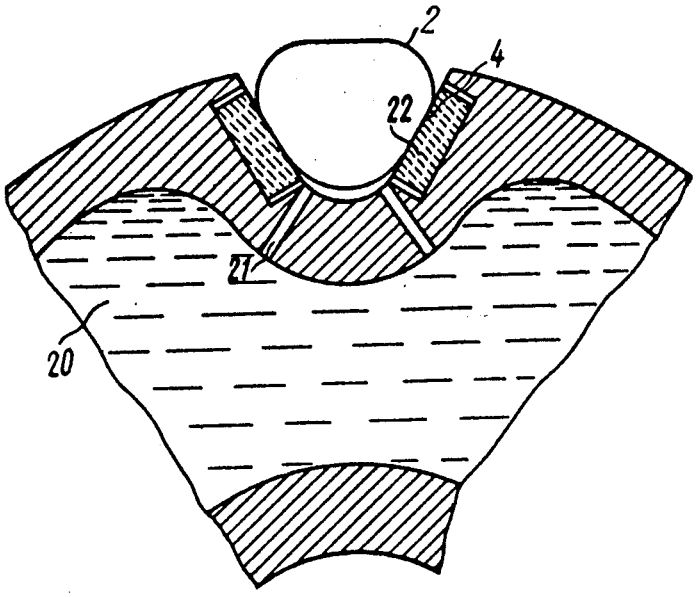
FIG. 14 represents a modification of the mandrel having cavities and passages for feeding a working medium to the shaping grooves.

For providing a greater resistance of the shaping grooves 4 to wear and improving the quality of the squeezed rope elements 2 it is preferable that the mandrel 3 (FIG. 14) have cavities 20 and passages 21 for supplying a working medium to the shaping grooves 4. It is also preferable that the walls of the grooves 4 be reinforced by wear-resistant inserts 22 fabricated, for example, from a hard-alloy material.

The proposed machine is further provided with an additional distribution template 23 having guide holes 24 and stranding dies 25 in which thanks to the rotation of the rotor 1 and the pulley of a drawing mechanism (not shown) a pinch portion of the rope 26 is twisted from the rope elememts 2.

The rope-twisting machine according to the invention operates in the following manner.

Prior to starting, the rope elements 2 to be squeezed are withdrawn from the rotor 1 (FIG. 2), threaded through the guide holes 9 of the distribution template 8, shaping grooves 4 of the mandrel 3, and guide holes 24 of the additional distribution template 23 to be thereafter passed to the stranding dies 25 in which due to the rotation of the rotor 1 and the pulley of a drawing mechanism (not shown) a feed portion of the rope 26 is twisted from the rope elements 2. Therewith, the pressure rollers 6 (FIG. 4) are forced away from the mandrel 3 by causing them to move axially, or by moving the mandrel 3 along the axis of the rotor 1, or by eccentrical adjustment.

Subsequent to pulling the feed portion of the rope 26 onto a winding mechanism (not shown) the pressure rollers 6 are engaged. The mandrel 3 rotates together with the rotor 1 at an absolute angular velocity $\Omega$, whereas the casing 5, when it is kinematically linked with the rotor 1 or provided with an individual drive, rotates in the opposite direction at an absolute angular velocity $\omega$.

In this case the rate "n" of rotation of the rollers 6 relative to the mandrel 3 is:

$$n=(\Omega+\omega)/2\pi.$$

When $\omega=0$ in the case of a rigid connection of the casing 5 (FIG. 6) with the base, squeezing of the rope elements 2 occurs exclusively thanks to the rotation of the mandrel 3 with the rotor 1 relative to the casing 5 with the pressure rollers 6.

When twisting the rope elements 2 into the rope 26, it is preferable that these rope elements have pretwisted substantially triangular cross-section corresponding to the spiral shape of the elements 2 in this rope 26.

The required twisting effect is attained by twisting the rope elements 2 and their untwisting.

For this purpose the machine must be provided with a means (not shown) for untwisting the rope elements 2 being squeezed, whereby each of the rope elements 2 is rotated relative to the rotor 1 in the opposite direction at an angular velocity of $\Omega'$ approximating the rotational speed $\Omega$ of the rotor 1.

Figure 1:
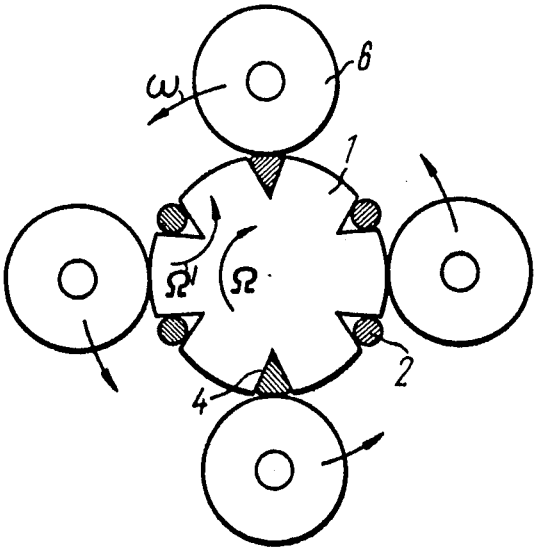
FIG. 1 is a line diagram of the process of intermittent pulsewise rotational squeezing of rope elements according to the invention.

Therewith, during the free passage (without squeezing) the rope elements 2 are also rotated in the shaping grooves 4 (FIG. 1) gradually turning by their surface toward the pressure rollers 6, which imparts a twisting effect while squeezing.

In order to enhance the twisting effect imparted to the rope elements 2 in the shaping grooves 4, the latter may be inclined to the axis of the mandrel 3 (FIG. 7) at an angel "$\alpha$" as in thread-cutting.

For making a combined shaped-strand rope, such as triangular-strand rope covered by a layer of substantially flattened or oval strands, it is necessary to make use of a mandrel 3 (FIG. 13) having shaping grooves of various configurations.

For example, for making a combined shaped-strand rope made-up of four triangular strands and eight oval or flattened strands the mandrel 3 must have four symmetrically arranged grooves 27 of triangular configuration and eight shaping grooves of oval or flattened configuration.

For making a rope comprising a layer of the rope elements 2 in the form of wires it is necessary to use a mandrel 3 (FIG. 9) having a corresponding number of shaping grooves 4 of required configuration.

In view of the foregoing, the proposed rope-twisting machine for making ropes makes it possible to produce a wide range of ropes, including those that cannot be made by prior art machines, particularly (a) shaped-strand ropes (viz., triangular-strand, oval-strand, flat-strand ropes, etc.);

(b) combined ropes comprising at least two strand types of construction; and (c) spiral or helical ropes (locked, semilocked, and the like) including at least one layer of shaped wire (viz., wedge-shaped, lens-shaped, oval, etc.).

What is claimed is:

1. A rope-twisting machine for making ropes comprising arranged on a base in succession:

a rotor carrying rope elements;

a mandrel rigidly connected to said rotor;

shaping grooves provided in said mandrel;

a casing arranged concentrically around said mandrel and capable of relative rotation with said rotor; and pressure rollers mounted in said casing for rolling on an outer periphery of said mandrel as the mandrel is rotated to press the rope elements into said shaping grooves to deform the rope elements to the shape of the shaping grooves, the axes of said pressure rollers being disposed in planes passing through the axis of rotation of the rotor.

2. A rope-twisting machine as defined in claim 1, in which said casing is linked with said rotor for motion relative to said rotor.

3. A rope-twisting machine as defined in claim 1, in which said casing is provided with an individual rotating drive.

4. A rope-twisting machine as defined in claim 1, in which said casing is provided with a counterweight secured on its periphery.

5. A rope-twisting machine as defined in claim 1, in which said casing is rigidly connected to the base.

6. A rope-twisting machine as defined in claim 1, in which in order to compensate for wear and adjust the degree of squeezing of the rope elements, each said pressure roller is arranged in said casing on an eccentric shaft.

7. A rope-twisting machine as defined in claim 1, in which in order to compensate for wear and adjust the degree of squeezing said mandrel and said pressure rollers are tapered and capable of axial adjustable reciprocations.

8. A rope-twisting machine ad defined in claim 1, which said mandrel has cavities and passages for feeding a working medium to said shaping grooves.

* * * * *